US005759989A

United States Patent [19]

Scialla et al.

[11] Patent Number: 5,759,989

[45] Date of Patent: Jun. 2, 1998

[54] STABLE AQUEOUS EMULSIONS OF NONIONIC SURFACTANTS WITH A VISCOSITY CONTROLLING AGENT

[75] Inventors: Stefano Scialla; Sergio Cardola; Giulia Ottavia Bianchetti, all of Rome, Italy

[73] Assignee: The Procter & Gamble Company, Cincinnati, Ohio

[21] Appl. No.: 966,955

[22] Filed: Nov. 10, 1997

Related U.S. Application Data

[63] Continuation of Ser. No. 564,373, Dec. 21, 1995, abandoned.

[30] Foreign Application Priority Data

Jul. 13, 1993 [EP] European Pat. Off. ..... 93870135

[51] Int. Cl.[6] ..... C11D 1/72; C11D 3/28; C11D 3/395

[52] U.S. Cl. ..... 510/500; 510/191; 510/221; 510/223; 510/229; 510/235; 510/238; 510/278; 510/283; 510/303; 510/309; 510/318

[58] Field of Search ..... 510/191, 221, 510/223, 229, 235, 238, 278, 283, 303, 309, 318; 252/186.28

[56] References Cited

U.S. PATENT DOCUMENTS

| | | | |
|---|---|---|---|
| 3,915,974 | 10/1975 | Cairncross | 260/250 |
| 3,956,159 | 5/1976 | Jones | 252/104 |
| 4,446,044 | 5/1984 | Rutkiewic et al. | 252/170 |
| 4,648,987 | 3/1987 | Smith et al. | 252/559 |
| 4,772,413 | 9/1988 | Massaux et al. | 252/102 |
| 4,783,278 | 11/1988 | Sanderson et al. | 252/95 |
| 4,981,606 | 1/1991 | Barnes | 252/95 |
| 4,997,910 | 3/1991 | Garapon et al. | 528/366 |
| 5,409,632 | 4/1995 | Showell et al. | 252/186.23 |
| 5,464,563 | 11/1995 | Moore et al. | 252/186.29 |

FOREIGN PATENT DOCUMENTS

| | | | |
|---|---|---|---|
| 0 266 904 A2 | 10/1987 | European Pat. Off. | C11D 3/386 |
| 358472 | 3/1990 | European Pat. Off. . | |
| 1 505 654 | 3/1978 | United Kingdom | C07D 213/79 |

*Primary Examiner*—Paul Lieberman
*Assistant Examiner*—Charles Boyer
*Attorney, Agent, or Firm*—Robert B. Aylor

[57] ABSTRACT

Stable aqueous emulsions comprising dipicolinic acid or certain derivatives thereof and hydrophilic and hydrophobic nonionic surfactants are disclosed, as well as a process for preparing said compositions. The dipicolinic acid and derivatives thereof build viscosity in said compositions.

10 Claims, No Drawings

STABLE AQUEOUS EMULSIONS OF NONIONIC SURFACTANTS WITH A VISCOSITY CONTROLLING AGENT

This is a continuation of application Ser. No. 08/564,373, filed on Dec. 21, 1995, now abandoned.

TECHNICAL FIELD

The present invention relates to cleaning compositions. More particularly, the cleaning compositions according to the present invention are stable aqueous emulsions of nonionic surfactants which comprise a viscosity control agent.

BACKGROUND

A great variety of cleaning compositions have been described in the art. For instance, in co-pending European Patent Application EP 92870188.7, a particular type of cleaning compositions is described which are aqueous emulsions of a nonionic surfactant system. Such emulsions find a preferred application in the formulation of bleaching compositions comprising hydrogen peroxide or water soluble sources thereof and a liquid hydrophobic bleach activator, or any other hydrophobic ingredient which needs to be separated from hydrogen peroxide.

Alternatively, such emulsions can be used to formulate products which do not contain hydrogen peroxide. In the latter case, such emulsions can be useful because they allow to keep a given hydrophobic ingredient separate from the aqueous phase, with which said hydrophobic ingredient could react, e.g., by hydrolysis.

It is also generally desirable to be able to efficiently control the viscosity of cleaning compositions. Indeed, viscosity is an essential aspect of cleaning compositions in relation to ease of pouring and dispensing, and spreadability. This latter aspect is particularly important when cleaning compositions are used to clean hard surfaces, especially on inclined or vertical surfaces such as toilet bowls, or in the context of laundry. In those instances, the cleaning compositions must be thick enough for a controlled application onto fabrics, and for a good cling onto surfaces.

It is thus an object of the present invention to formulate aqueous emulsions of nonionic surfactants wherein the viscosity can be easily controlled.

A variety of thickening agents or hydrotrope compounds or hydrotropes are available for this purpose. By thickening agent or hydrotrope compounds, it is meant herein compounds whose sole function is to regulate the viscosity of the compositions. Such compounds are however rather undesirable for a variety of reasons. Indeed, they can significantly increase formula cost without participating to the overall cleaning performance, they may involve processing and safety issues, they may affect product stability, particularly in extreme acidic conditions, and they may affect the cleaning performance of the compositions.

It is thus an object of the present invention to formulate such a composition without having to use a thickener or hydrotrope compound.

It has now been found that this object could be met by formulating dipicolinic acid, or derivatives thereof in an aqueous emulsion of nonionic surfactant. Depending on the phase in which it is added, dipicolinic acid or, where appropriate, derivatives thereof will increase or decrease significantly the formulation's viscosity.

Another advantage of the present invention is that it is only required to use a very small amount of dipicolinic acid or derivatives thereof in order to obtain the desired effect, which makes the present invention particularly cost-efficient.

Another advantage of the present invention is that it allows for the formulation of compositions whith target viscosity which are pseudoplastic, i.e. which are less viscous at higher shear stresses. Pseudoplastic compositions achieve the multiple and somewhat contradictory objects of being easy to dispense, i.e. rather less viscous, and providing good cling onto surfaces, i.e. rather more viscous.

Yet another advantage of the present invention is that dipicolinic acid or derivatives thereof have been found to provide additional stability to the compositions herein which may comprise hydrogen peroxide as an optional but preferred compound.

Yet another advantage of the present invention is that it allows to achieve a given viscosity target with a lower surfactant level, compared to a composition without dipicolinic acid or derivatives thereof.

Dipicolinic acid and derivatives appear to have been disclosed in EP 266 904, EP 358 472, U.S. Pat. No. 3,956,159, EP 490 417, U.S. Pat. No. 3,915,974, GB 1,505, 654, U.S. Pat. No. 4,311,843.

SUMMARY OF THE INVENTION

The present invention is a stable aqueous emulsion comprising a hydrophilic nonionic surfactant and a hydrophobic nonionic surfactant, said stable aqueous emulsion further comprising a viscosity-regulating amount of a compound of the formula:

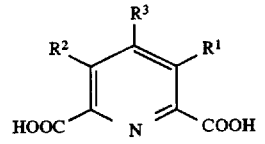

Wherein $R^1$, $R^2$ and $R^3$ are independently H, or $C_{1-20}$ alkyl, alkenyl, or alkynyl; or salts thereof. Mixtures of said compounds are also suitable for use herein. Particularly preferred for use herein is dipicolinic acid, i.e where $R_1$, $R_2$ and $R_3$ are all H.

DETAILED DESCRIPTION OF THE INVENTION

The compositions according to the present invention are stable aqueous emulsions of nonionic surfactants. By stable emulsion it is meant an emulsion which does not macroscopically separate into distinct layers, upon standing for at least two weeks at 20° C., more preferably at least six months.

The compositions according to the present invention are aqueous. Accordingly, the compositions according to the present invention comprise from 10% to 95% by weight of the total composition of water, preferably from 30% to 90%, most preferably from 60% to 85%. Deionized water is preferably used.

The compositions according to the present invention are emulsions of nonionic surfactants. Said emulsions of nonionic surfactants comprise at least two nonionic surfactants. In order to form emulsions which are stable, said two nonionic surfactants must have different HLB values (hydrophilic lipophilic balance), and preferably the difference in value of the HLBs of said two surfactants is at least 1, more preferably at least 3. By appropriately combining at least two of said nonionic surfactants with different HLBs in water, emulsions according to the present invention will be formed.

One of said nonionic surfactants used herein is a nonionic surfactant with an HLB above 11 (herein referred to as hydrophilic nonionic surfactant), whereas the other one is a nonionic surfactant with an HLB below 10 (herein referred to as hydrophobic nonionic surfactant).

Suitable nonionic surfactants for use herein include alkoxylated fatty alcohols. Indeed, a great variety of such alkoxylated fatty alcohols are commercially available which have very different HLB values (hydrophilic lipophilic balance). The HLB values of such alkoxylated nonionic surfactants depend essentially on the nature of the alkoxylation and the degree of alkoxylation. Hydrophilic nonionic surfactants tend to have a higher degree of alkoxylation, while hydrophobic surfactants tend to have a lower degree of alkoxylation and a long chain fatty alcohol. Surfactants catalogs are available which list a number of surfactants including nonionics, together with their respective HLB values.

The compositions according to the present invention comprise from 2% to 70% by weight of the total composition of said hydrophilic and hydrophobic nonionic surfactants, preferably from 3% to 40%, most preferably from 4% to 30%.

The compositions according to the present invention may further comprise other nonionic surfactants which should however not significantly alter the weighted average HLB value of the overall composition.

The compositions according to the present invention further comprise as an essential element a viscosity-regulating amount of dipicolinic acid (2,6 pyridinedicarboxylic acid) or derivatives thereof. By viscosity-regulating, it is meant herein any amount of dipicolinic acid or derivatives thereof in a given composition which will provide an increase or decrease in viscosity compared to the same composition without dipicolinic acid or derivatives thereof, while maintaining acceptable stability.

As used herein, the expression "dipicolinic acid or derivatives thereof" refers to compounds of the formula:

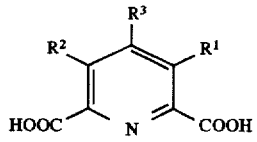

Wherein $R^1$, $R^2$ and $R^3$ are independently H, or $C_{1-20}$ alkyl, alkenyl, or alkynyl; or salts thereof. Mixtures of said compounds are also suitable for use herein. Particularly preferred for use herein is dipicolinic acid, i.e where $R^1$, $R^2$ and $R^3$ are all H.

The compositions herein are not limited to any specific viscosity, and depending on the exact use envisioned, various viscosities may be achieved. In any case, the addition of the dipicolinic acid or derivatives thereof to a given composition may produce a viscosity increase or decrease of from 5 cps to 2000 cps, preferably from 50 cps to 1000 cps, at a given shear rate, compared to the same composition without dipicolinic acid or derivatives thereof. The decrease or increase is greater when measured at low shear rates (e.g. 12 rpm).

The present invention offers great flexibility in viscosity control. Indeed, it has been found that dipicolinic acid decreases viscosity when it is added to the hydrophilic phase of the emulsion, i.e. the phase comprising said hydrophilic nonionic surfactant. On the contrary, dipicolinic acid or derivatives thereof increase the viscosity when it is added in certain amounts to the hydrophobic phase, i.e the phase comprising said hydrophobic nonionic surfactant.

When added to the hydrophilic phase, only dipicolinic acid should be used. When added to the hydrophobic phase, dipicolinic acid can be used as well as derivatives thereof. It is speculated that the derivatives of dipicolinic acid herein are of interest as they are more hydrophobic than dipicolinic acid. Thus they are more soluble than dipicolinic acid in the hydrophobic phase and can therefore participate to increasing viscosity.

Typically the compositions according to the present invention may comprise from 0.01% to 10% by weight of the total composition of dipicolinic acid or derivatives thereof, preferably from 0.01% to 1%. Additional flexibility in viscosity control can be obtained through the amount of dipicolinic acid or derivatives thereof added. Indeed it has been found that when it is added in the hydrophobic phase, dipicolinic acid or derivatives thereof increase viscosity when they are added in certain amounts, but then decrease viscosity if more dipicolinic acid or derivatives thereof is added. It is speculated that, at his point, dipicolinic acid or derivatives thereof start to form crystals which are no longer soluble in the hydrophobic phase, thus the viscosity start decreasing again.

It has also been observed that the exact viscosity profile as a function of the amount of dipicolinic acid or derivative thereof further depends on the pH of the composition. For each composition, viscosity profile curves can be plotted as a function of the amount of dipicolinic acid or derivatives thereof, and depending on whether dipicolinic acid is added in the hydrophilic phase, or whether dipicolinic acid or derivatives thereof are added in the hydrophobic phase.

It has been also found that the pH of the formulation influences its stability. Other than this, there are no other limitations in the pH of the composition. However, bleaching ingredients being optional but preferred ingredients of the compositions herein, it is of course necessary, for chemical stability purposes to formulate the compositions herein with bleaches at a pH as is of from 0 to 6, preferably of from 0.5 to 5. The pH of the composition can be trimmed by all means available to the man skilled in the art.

Accordingly, preferred compositions according to the present invention comprise bleaches, i.e. hydrogen peroxide or water-soluble sources thereof. Suitable water-soluble sources of hydrogen peroxide include perborate, percarbonate and persilicate salts. Hydrogen peroxide is most preferred to be used in the compositions according to the present invention. Typically, the compositions according to the present invention comprise from 0.5% to 20% by weight of the total composition of hydrogen peroxide, preferably from 2% to 15%, most preferably from 3% to 10%.

The compositions according to the present invention may further comprise a bleach activator as an optional ingredient. By bleach activator, it is meant herein any compound which reacts with hydrogen peroxide to form a peracid. Suitable bleach activators for use herein typically belong to the class of esters, amides, imides, or anhydrides. A particular family of bleach activators of interest in the present invention were disclosed in applicant's co-pending European patent application No 91870207.7. Particularly preferred in that family is acetyl triethyl citrate which was also disclosed in the context of bar soaps in FR 2 362 210. Acetyl triethyl citrate has the advantages that it is environmentally friendly as it eventually degrades into citric acid and alcohol. Furthermore, acetyl triethyl citrate has a good hydrolytical stability in the product upon storage and it is an efficient bleach activator. As used herein and unless otherwise specified, the term bleach activator includes mixtures of bleach activators.

In the embodiment of the present invention, wherein the compositions comprise a bleach activator which is a hydrophobic liquid ingredient, the nonionic surfactant system to be chosen to emulsify said bleach activator depends on the HLB value of said bleach activator. Accordingly, a suitable way to proceed is to determine the HLB value of the hydrophobic liquid ingredient (bleach activator), then select both the hydrophobic nonionic surfactants which have HLB values below said HLB value of said hydrophobic liquid ingredient and the hydrophilic nonionic surfactants which have HLB values above said HLB value of said hydrophobic liquid ingredient, wherein the difference in the HLB values of said hydrophobic and hydrophilic nonionic surfactants is preferably at least 3.

In said embodiment comprising said bleach activator which is a hydrophobic ingredient, the emulsifying system meets the equation:

$$HLB(X) = \frac{\%A}{100} \times HLB(A) + \frac{\%B}{100} \times HLB(B) \text{ and } \%A + \%B = 100\%;$$

where X refers to the hydrophobic liquid ingredient to emulsify, A refers to one of said nonionic surfactants (hydrophilic or hydrophobic), and B refers to the other said nonionic surfactant (hydrophilic or hydrophobic).

In an embodiment of the present invention wherein the compositions comprise acetyl triethyl citrate with an HLB of about 10 as the bleach activator, an adequate nonionic surfactant system would comprise a hydrophobic nonionic surfactant with an HLB from 1 to 10, and a hydrophilic nonionic surfactant with an HLB of above 11. A particularly suitable system comprises a hydrophobic nonionic surfactant with an HLB of 6, for instance a Dobanol@ 23-2 and a hydrophilic nonionic surfactant with an HLB of 15, for instance a Dobanol@ 91-10. Another suitable nonionic surfactant system comprises a Dobanol@ 23-6.5 (HLB about 12) and a Dobanol@ 23 (HLB below 6). All these Dobanol@ surfactants are commercially available from Shell.

The compositions according to the present invention may further comprise the usual optional ingredients such as perfumes, dyes, optical brighteners, builders and chelants, pigments, enzymes, dye transfer inhibitors, solvents, buffering agents and the like.

The compositions according to the present invention are particularly useful as laundry pretreaters, i.e compositions which are dispensed and left to act onto fabrics before they are washed, or as laundry additives to be used together with detergents to boost their performance, or as dishwashing compositions to be used either in the dishwashing machines or by hand, or as hard surface cleaners, or as toilet bowl cleaners, or as carpet cleaners to be used either by direct application onto the carpets or in carpet cleaning machines.

The present invention further encompasses a process for the manufacture of the compositions described herein. The process according to the present invention comprises at least three steps:

In the first step, a hydrophobic mixture is prepared which comprises said hydrophobic nonionic surfactant, together with other, optional, hydrophobic ingredients which are to be formulated in the composition, such as perfumes, solvents, enzymes, bleach activators and polymers.

In the second step, a hydrophilic mixture is prepared which comprises at least said water, and said hydrophilic nonionic surfactant. Said hydrophilic mixture preferably further comprises other hydrophilic ingredients which are to be formulated in the composition such as dyes, optical brighteners, builders, chelants, hydrogen peroxide and buffering agents.

Depending on the viscosity regulating effect, i.e. increase or decrease, dipicolinic acid is added respectively in said first step or second step. When added to said hydrophobic phase, it may be necessary to heat the phase slightly so as to help full dissolution. Naturally, said first and said second steps can be performed in any order, i.e second step first is also suitable.

In the third step of the process according to the present invention, said hydrophobic mixture and said hydrophilic mixture are mixed together.

The present invention is further illustrated by the following examples.

EXAMPLES

Compositions are made which comprise the listed ingredients in the listed proportions (weight %).

Example 1

| | |
|---|---|
| Dobanol® 91-10 | 1 |
| Dobanol® 91-2.5 | 4 |
| Citric acid | 6 |
| Hydrogen peroxide | 6 |
| Dipicolinic acid | 0.05 (in hydrophobic phase) |
| perfume | 0.5 |
| Water and minors | up to 100% |
| pH = 1 | |

Viscosity (with Brookfield@ DV rotational viscosimeter, spindle No. 2) at 12 rpm, 20° C. after 1 day: 470 cps (reference without dipicolinic acid 105 cps).

Example 2

| | |
|---|---|
| Dobanol® 91-10 | 1 |
| Dobanol® 91-2.5 | 4 |
| Citric acid | 6 |
| Hydrogen peroxide | 6 |
| Dipicolinic acid | 0.2 (in hydrophobic phase) |
| perfume | 0.5 |
| Water and minors | up to 100% |
| pH = 1 | |

Viscosity (with Brookfield@ DV rotational viscosimeter, spindle No. 2) at 12 rpm, 20° C. after 1 day 100 cps. Reference without dipicolinic acid: 105 cps.

Example 3

| | |
|---|---|
| Dobanol® 45-7 | 6 |
| Dobanol® 91-10 | 3 |
| Dobanol® 23-2 | 6 |
| Hydrogen peroxide | 7.5 |
| Acetyl triethyl citrate | 10 |
| Dipicolinic acid | 0.5 (in hydrophilic phase) |
| Water and minors | up to 100% |
| pH = 4 | |

Viscosity (with Brookfield@ DV+ rotational viscometer, spindle No. 5) at 50 rpm, 25° C. after 1 week 440 cps (reference without dipicolinic acid 632 cps).

Example 4

| | |
|---|---|
| Dobanol® 91-10 | 1.2 |
| Dobanol® 91-2.5 | 4.8 |
| Citric acid | 6 |
| Hydrogen peroxide | 6 |
| Dipicolinic acid | 0.05 (in hydrophilic phase) |
| perfume | 0.5 |
| Water and minors | up to 100% |
| pH = 2.5 | |

Viscosity (with Brookfield@ DV rotational viscosimeter, spindle No. 2) at 12 rpm, 20° C. after 1 day: 670 cps (reference without dipicolinic acid 1300 cps).

Example 5

| | |
|---|---|
| Dobanol® 91-10 | 1.2 |
| Dobanol® 91-2.5 | 4.8 |
| Citric acid | 6 |
| Dipicolinic acid | 0.05 (in hydrophobic phase) |
| perfume | 0.5 |
| Water and minors | up to 100% |
| pH = 2.5 | |

Viscosity at 12 rpm, 20° C. after 1 day: 575 cps (reference without dipicolinic acid 470 cps).

Example 6

| | |
|---|---|
| Dobanol® 91-10 | 1.2 |
| Dobanol® 91-2.5 | 4.8 |
| Citric acid | 6 |
| Hydrogen peroxide | 12 |
| Dipicolinic acid | 0.05 (in hydrophobic phase) |
| perfume | 0.5 |
| Water and minors | up to 100% |
| pH = 2.5 | |

Viscosity at 12 rpm, 20° C. after 1 day: 590 cps (reference without dipicolinic acid 470 cps).

What is claimed is:

1. A process for the manufacture of a stable aqueous detergent emulsion wherein the viscosity of said emulsion is reduced said emulsion comprising a hydrophilic nonionic surfactant having an HLB above 11, a hydrophobic nonionic surfactant having an HLB below 10 and a viscosity reducing amount of dipicolinic acid or a salt thereof, said process comprising the steps of:

a) preparing a hydrophobic mixture comprising said hydrophobic nonionic surfactant, together with one or more other hydrophobic ingredients selected from the group consisting of perfumes, solvents, enzymes, bleach activators and polymers;

b) preparing a hydrophilic mixture comprising at least water and said hydrophilic nonionic surfactant and dipicolinic acid or salt thereof and optionally other hydrophilic ingredients selected from the group consisting of dyes, optical brighteners, builders, chelants, hydrogen peroxide and buffering agents; and c) subsequently mixing said hydrophobic mixture and said hydrophilic mixture together to form said detergent emulsion.

2. A process according to claim 1 wherein said detergent emulsion comprises 0.01% to 10% by weight of the total composition of dipicolinic acid or salt thereof.

3. A process according to claim 1 wherein the total hydrophilic and hydrophobic nonionic surfactant amount is from 2% to 70% by weight of the total emulsion.

4. A process according to claim 1 wherein the difference between the HLB values of the hydrophilic nonionic surfactants and the hydrophobic nonionic surfactants is at least 3.

5. A process according to claim 1 wherein the detergent emulsion contains from 0.5% to 20% hydrogen peroxide, or a water soluble source thereof.

6. A process according to claim 5 which also comprises a bleach activator.

7. A process according to claim 6 wherein said bleach activator is acetyl triethyl citrate.

8. A process according to claim 2 wherein the amount of dipicolinic acid or salt thereof is from about 0.01% to 1% by weight of the total composition.

9. A process according to claim 3 wherein the hydrophilic and hydrophobic nonionic surfactants are present at from about 3% to about 40% by weight of the total emulsion.

10. A process according to claim 9 wherein the total hydrophilic and hydrophobic nonionic surfactant is present in an amount of from about 4% to about 30% by weight of the total emulsion.

* * * * *